US006712905B2

(12) United States Patent
Nurmi et al.

(10) Patent No.: US 6,712,905 B2
(45) Date of Patent: Mar. 30, 2004

(54) DOCTOR BLADE DEVICE

(76) Inventors: Janne Nurmi, Weinbergstr. 34, D-64285 Darmstadt (DE); Timo Sironen, Wilhelm Schildtin katu 10 A 16, FI-40740 Jyvaeskylae (FI)

( * ) Notice: Subject to any disclaimer, the term of this patent is extended or adjusted under 35 U.S.C. 154(b) by 0 days.

(21) Appl. No.: 10/146,503

(22) Filed: May 14, 2002

(65) Prior Publication Data

US 2003/0029377 A1 Feb. 13, 2003

(30) Foreign Application Priority Data

May 17, 2001 (DE) ..... 201 08 270 U

(51) Int. Cl.[7] ..... B05C 11/04

(52) U.S. Cl. ..... 118/118; 118/126; 118/203; 118/261; 118/413; 162/281; 15/256.5

(58) Field of Search ..... 118/118, 126, 118/203, 261, 413; 162/281; 15/256.5; 101/157, 169, 365

(56) References Cited

U.S. PATENT DOCUMENTS 6,267,818 B1 * 7/2001 Volpe, Jr. ..... 118/103

* cited by examiner

*Primary Examiner*—Laura Edwards
(74) *Attorney, Agent, or Firm*—M. K. Silverman; Yi Li

(57) ABSTRACT

A doctor blade device for machines for the coating of fibrous webs, in particular of paper or cardboard, and for keeping rotating rollers clean has a leaf-shaped doctor blade element (1) which is held by a holding means (2) and which, for a change, can be drawn out laterally on the holding means (2). The doctor blade element (1) is provided at least on one side with a grip part (8).

20 Claims, 1 Drawing Sheet

DOCTOR BLADE DEVICE

BACKGROUND OF THE INVENTION

1. Field of the Invention

The invention relates to a doctor blade device, also called a scraper device, for machines for the coating of fibrous webs.

2. Description of the Related Art

Devices of this type are generally known, in particular in the paper industry, for the coating of paper or cardboard or for keeping rotating rollers clean (see, for example, DE 198 41 637 A1). In this context, a leaf-shaped doctor blade or scraper element runs axially along a roller, the front end of the doctor blade element being pressed with a scraper edge against the surface of the roller. The doctor blade element is guided and held in a holding means. The holding means is generally designed to be pneumatically adjustable in the direction of the roller.

The doctor blade element is in this case mounted, for example via a multiplicity of pins, in a longitudinal groove of the holding means. When the doctor blade element, which is subjected to high wear, is exchanged, it is drawn out of the holding means laterally, that is to say axially parallel to the roller. A new doctor blade element is subsequently pushed into the holding means in the same way in the opposite direction.

This exchange has the disadvantage, however, that there are sometimes considerably difficulties in recovering the doctor blade element or scraper element from the holding means. The doctor blade element, due to operation, is often heavily soiled and is stuck to the holding means. As a result, considerable forces have to be exerted by the operator in order to pull the doctor blade element out of the holding means.

One problem, here, is that considerable sliding lengths are involved, since the length of the rollers and therefore also of the doctor blade element amounts to several meters. Furthermore, the application area for the pulling forces to be exerted is restricted to the narrow front region of the doctor blade element with which the latter projects from the holding means. Since the exchange work is carried out several meters above the floor of a scaffold or platform, there is consequently also a high risk of accidents when the exchange of the doctor blade element presents difficulties because of heavy soiling and/or stubborn sticking.

SUMMARY OF THE INVENTION

The object on which the present invention is based, therefore, is to provide a doctor blade device, in which the doctor blade element can be exchanged essentially reliably by relative simple means.

This object is achieved, according to the invention, by means of a doctor blade device for machines for the coating of fibrous webs, in particular of paper or cardboard, and for keeping rotating rollers clean, with a leaf-shaped doctor blade element which is held by a holding means and which, for a change, can be drawn out laterally on the holding means, wherein the doctor blade element is provided at least on one side with a grip part.

By virtue of the grip part according to the invention, then, a separate region or part on the doctor blade element is provided, which may be provided specially for the exchange operation.

When, in an advantageous refinement of the invention, there is provision for the grip part to be located outside the normal working range, for example in a corresponding prolongation of the doctor blade element, it can then be adapted optimally to the set object. This applies, for example, with regard to appropriate grip and size. Moreover, the most diverse possible driving and retaining members can be provided on or in the grip part in a simple way.

For example, a bore, into which a push-out tool appropriately engages with a mandrel or pin, can be introduced in the grip part in a simple way. A very reliable and positive connection is thereby afforded, with the result that, even in the case of high resistance forces which occur, for example, because of heavy soiling and resulting sticking, it becomes possible for the doctor blade element to be exchanged to be pulled out.

Conversely, of course, it is also possible for the grip part to be provided with corresponding elevations, abutments, shoulders, bosses or pins and the like, on which or in which a push-out tool can engage with a corresponding countermember, for example a lug.

In a highly advantageous refinement of the invention, there may be provision for the width of the grip part to correspond at least approximately to the width of the holding means. In this case, the front region of the doctor blade element remains unchanged for its satisfactory functioning. The region with which the grip part projects laterally from the holding means is generally fully sufficient for this region to be capable of being used as a grip part.

Further advantageous refinements and developments may be gathered from the remaining subclaims and from the exemplary embodiment described in principle below with reference to the drawing in which:

DETAILED DESCRIPTION

Figure 1:
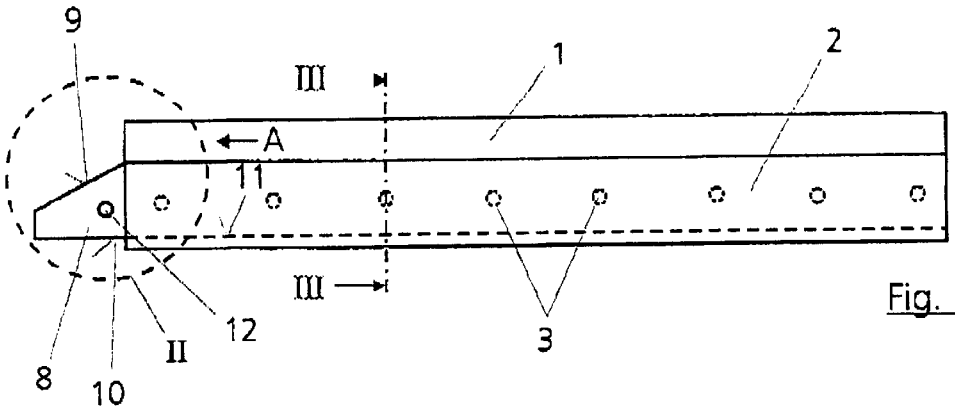
FIG. 1 shows a top view of a device with a grip part according to the invention.

The doctor blade device has a leaf-shaped doctor blade element or scraper element 1 which is held and guided in a holding means 2. For this purpose, the doctor blade element 1 has a multiplicity of pins 3 which extend from the underside of the doctor blade element 1 and project into a slot 4 of the holding means 2. The doctor blade element 1 is firmly clamped in the holding means 2 in a known way. The doctor blade element 1 is pressed with a front doctor blade edge 5 against a fibrous web 7 running over a roller 6.

To exchange the doctor blade element 1, the latter must be drawn out of the holding means 2 laterally or axially, with respect to the-roller C, in the direction of the arrow A. For this purpose, then, the doctor blade element 1 is provided with a lateral prolongation which is designed as a grip part 8. The grip part 8 possesses a width b which corresponds at least approximately to the width of the holding means 2. A region a of the doctor blade element 1, the functioning of said region being unchanged, consequently remains on the front side.

Figure 2:
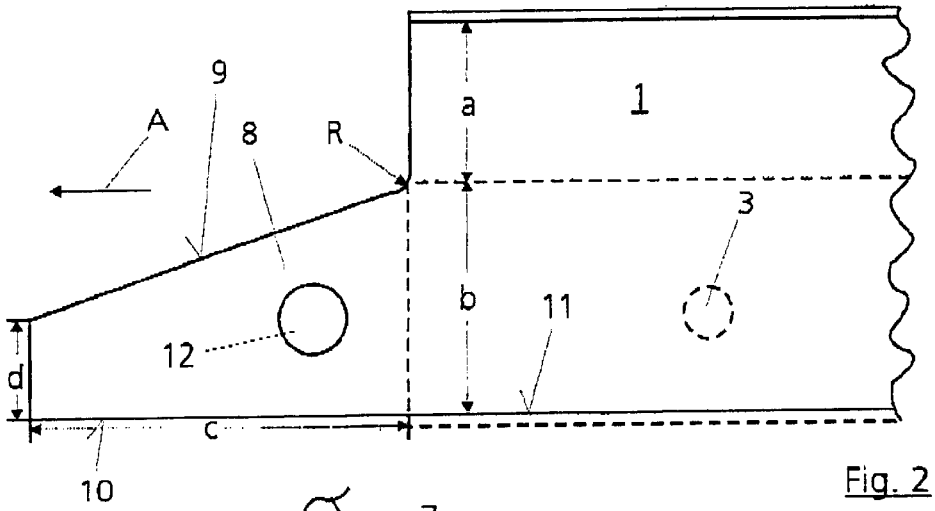
FIG. 2 shows an enlarged illustration of the lateral end region of the doctor blade element or scraper element with the grip part according to the invention, in an enlargement of the detail II in FIG. 1 (without the holding means)
Figure 3:
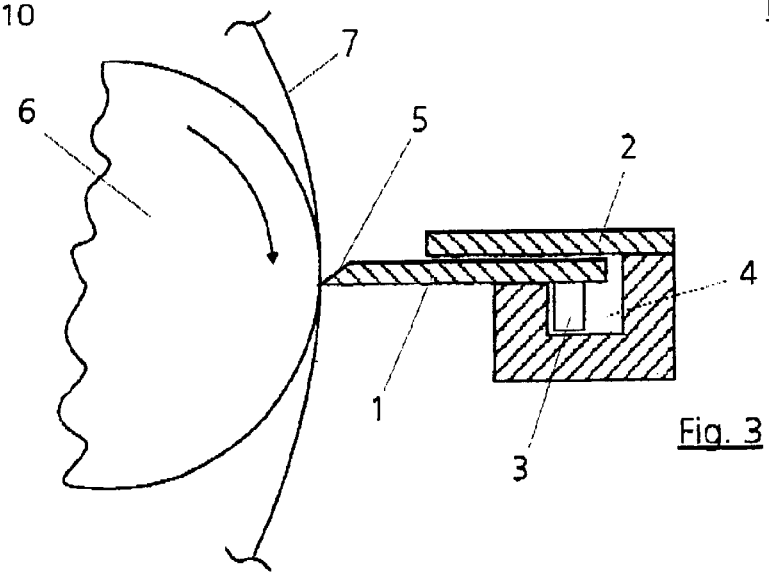
FIG. 3 shows a section along the line III—III in FIG. 1 in an enlarged illustration.

As may be seen particularly from the enlarged illustration in FIG. 2, the grip part 8 narrows outwardly toward its end to a width d. An oblique front edge 9 of the grip part 8 is thereby obtained. The rear edge 10 of the grip part 8 constitutes a prolongation of the rear edge 11 of the doctor blade element 1.

As is clear, there is a radius R between the "normal" end of the doctor blade element 1 in its front region and the oblique front edge 9. What is achieved thereby is greater safety against breaks which could occur due to sharp edges. This applies particularly when the doctor blade element 1 consists of a composite carbon-fiber or glass-fiber structure.

As may also be seen from FIGS. 1 and 2, the grip part 8 has a bore 12. A push-out tool, not illustrated, can engage with a corresponding mandrel or pin into the bore 12. A positive connection is thereby made, and consequently, when pulling forces are exerted in the direction of the arrow A, the push-out tool is reliably prevented from being capable of slipping off.

However, the bore 12, of course, constitutes only one possibility of making a reliable connection between a push-out tool and the grip part 8.

Further possibilities would be shoulders, elevations, pins or bolts and the like which project from the surface of the grip part 8 and consequently form corresponding engagement points for a push-out tool.

The upper and the lower surface of the grip part 8 may likewise be provided with corresponding roughenings, flutings and the like, in order to provide reliable application surfaces for a push-out tool.

The length of the grip part 8 over which the latter projects laterally from the holding means 2 may be between 40 and 100 mm. In practice, values of 60 to 80 mm, preferably 70 mm, have proved highly suitable. The width b of the grip part 8 may be between 40 and 50 mm.

In order to achieve a very good force profile or force distribution, in conjunction with the radius (R), it is advantageous if the final width d of the grip part 8 amounts approximately to half the initial width b. In the exemplary embodiment, this means that the width d is between 15 and 25 mm, preferably approximately 20 mm.

The front free or unchanged region a of the doctor blade element 1 should generally be between 30 and 40 mm, so that the doctor blade edge 5 of the doctor blade element 1 can be reground more than once.

By the grip part 8 being arranged and formed outside the normal working range of the doctor blade element 1, the work of the latter is not impaired by the grip part 8. On the other hand, a substantially higher accident safety is achieved by means of the grip part 8, along with a marked simplification in a change in the doctor blade element 1. This applies particularly to heavily soiled doctor blade elements 1, since substantially higher pulling forces can be exerted with a push-out tool by virtue of the grip part 8 and of the positive connection made in this way.

What is claimed is:

1. A doctor blade device for machines for the coating of paper or cardboard, or for keeping rotating rollers clean comprising a leaf-shaped doctor blade element which is held by a holding means, wherein said doctor blade element is provided at least on one side with a grip part which is formed by a prolongation of the doctor blade element, said grip part projecting laterally from the holding means and being located outside a working range; and for a change, said doctor blade element can be drawn out laterally on the holding means by gripping the grip part.

2. The doctor blade device as claimed in claim 1, wherein said grip part is provided with a driving or retaining member for a push-out tool.

3. The doctor blade device as claimed in claim 2, wherein said driving or retaining member has at least one bore in the grip part for engagement of the push-out tool.

4. The doctor blade device as claimed in claim 2, wherein said driving or retaining member has an elevation in the form of a shoulder, a pin or a boss as an engagement point for the push-out tool.

5. The doctor blade device as claimed in claim 1, wherein a transitional region between the doctor blade element and the grip part is curved.

6. The doctor blade device as claimed in claim 1, wherein a width (b) of the grip part corresponds at least approximately to a width of the holding means.

7. The doctor blade device as claimed in claim 6, wherein the width (b) narrows outwardly toward its end.

8. The doctor blade device as claimed in claim 7, wherein a final width (d) of the grip part corresponds approximately to a half of an initial width (b).

9. The doctor blade device as claimed in claim 1, wherein that a length of the grip part which extends laterally outside the working range is approximately 40 to 100 mm, preferably 60 to 80 mm.

10. The doctor blade device as claimed in claim 1, wherein the grip part extends laterally outward from a rear part of the doctor blade element, a front part of the doctor blade element remaining unchanged.

11. The doctor blade device as claimed in claim 10, wherein an unchanged region of the doctor blade element possesses a width (a) of from 30 to 40 mm.

12. A doctor blade device for machines for the coating of fibrous webs, in particular of paper or cardboard, or for keeping rotating rollers clean comprising a leaf-shaped doctor blade element which is held by a holding means and which, for a change, can be drawn out laterally on the holding means, wherein said doctor blade element is provided at least on one side with a grip part which is provided with a driving or retaining member for a push-out tool.

13. The doctor blade device as claimed in claim 12, wherein said grip part is formed by a prolongation of the doctor blade element, said grip part protecting laterally from the holding means and being located outside a working range.

14. The doctor blade device as claimed in claim 13, wherein said driving or retaining member has at least one bore in the grip part for engagement of the push-out tool.

15. The doctor blade device as claimed in claim 13, wherein said driving or retaining member has an elevation in the form of a shoulder, a pin or a boss as an engagement point for the push-out tool.

16. The doctor blade device as claimed in claim 13, wherein a transitional region between the doctor blade element and the grip part is curved.

17. The doctor blade device as claimed in claim 13, wherein a width (b) of the grip part corresponds at least approximately to a width of the holding means.

18. The doctor blade device as claimed in claim 17, wherein the width (b) narrows outwardly toward its end.

19. The doctor blade device as claimed in claim 18, wherein a final width (d) of the grip part corresponds approximately to a half of an initial width (b).

20. The doctor blade device as claimed in claim 13, wherein that a length of the grip part which extends laterally outside the working range is approximately 40 to 100 mm, preferably 60 to 80 mm.

* * * * *